United States Patent [19]

Williams

[11] 4,365,780

[45] Dec. 28, 1982

[54] REMOVABLE INSERT FOR FORMING HOLES IN CONCRETE AND THE LIKE

[75] Inventor: Craig B. Williams, Fayetteville, Ga.

[73] Assignee: M. A. Industries, Inc., Peachtree City, Ga.

[21] Appl. No.: 245,873

[22] Filed: Mar. 23, 1981

[51] Int. Cl.[3] ..... E02B 00/00

[52] U.S. Cl. ..... 249/11; 249/14; 249/177; 249/124

[58] Field of Search ..... 249/177, 11, 10, 14, 249/39, 124

[56] References Cited

U.S. PATENT DOCUMENTS

| | | | |
|---|---|---|---|
| 744,339 | 11/1903 | Haug | 249/177 |
| 1,212,997 | 1/1917 | Pate | 249/177 |
| 1,391,988 | 9/1921 | Zents | 249/177 |
| 1,851,339 | 3/1932 | Williams | 249/177 |
| 1,908,796 | 5/1933 | Suchan | 249/177 |
| 2,366,401 | 1/1945 | Haskell | 249/177 |
| 2,775,017 | 12/1956 | McDonough | 249/177 |

FOREIGN PATENT DOCUMENTS

| | | | |
|---|---|---|---|
| 225069 | 10/1959 | Australia | 249/177 |
| 938327 | 1/1956 | Fed. Rep. of Germany | 249/177 |
| 2421985 | 11/1975 | Fed. Rep. of Germany | 249/177 |
| 1217567 | 5/1960 | France | 249/177 |
| 1463905 | 11/1966 | France | 249/177 |
| 248419 | 5/1947 | Switzerland | 249/177 |
| 461150 | 2/1937 | United Kingdom | 249/177 |

*Primary Examiner*—John C. Bleutge
*Assistant Examiner*—A. H. Koeckert
*Attorney, Agent, or Firm*—Patrick F. Henry

[57] ABSTRACT

The present device is especially useful for positioning on forms prior to the pouring of concrete for removal therefrom to create holes in the concrete to receive inserts therein such as in making holes in concrete for steps to be used in a manhole. A tapered steel shaft of any selected length has a collar fixed near one end thereof with an elongated handle passing transversely therethrough. The collar has slanted cam edges on each end providing a cam surface which is approximately 12° from a line perpendicular to the axis. A second collar identical to the first is welded to a form, such as a steel concrete form used in pouring concrete for manholes. The second collar also has slanted cam edges providing a cam surface corresponding to the slanted cam edges on the first collar and there is a hole passing through the steel pin and through the second collar to receive a removable latch pin therein. The steel pin is inserted through the second collar and fixed in place until after the concrete is poured and has cured sufficiently at which time the latch pin is disengaged and the handle is turned to rotate a cam edge of the first collar against a cam edge of the second collar thereby providing a cam action which readily disengages the pin from the concrete and leaves a hole.

8 Claims, 2 Drawing Figures

REMOVABLE INSERT FOR FORMING HOLES IN CONCRETE AND THE LIKE

BACKGROUND OF THE INVENTION

1. Field of the Invention

The field of the invention is removable inserts for construction work and especially inserts for forming holes in concrete and the like particularly in the construction of manholes.

2. Description of the Prior Art

In the construction of manholes it is necessary to provide steps which is sometimes done by creating holes in the manhole wall during the construction thereof and thereafter using a prefabricated plastic step, such as the step disclosed in U.S. Pat. No. 4,100,997, to be driven into the holes in the manhole. If the manhole is constructed from poured concrete it has been the practice in the past to provide inserts in the concrete which are removed after the concrete has cured to leave the holes. This has involved the use of pins and inserts and angle iron supports to place the inserts in the proper position and to make it possible to remove the inserts with a minimum of difficulty. Still there has been a problem in connection with the proper positioning of the inserts and particularly with respect to the removal of the inserts after the concrete has cured (sometimes called stripout). A lever bar is used to move two pins connected by steel plate or angle iron. During removal the pin-plate assembly will cock and jam making removal time consuming and difficult.

SUMMARY OF THE INVENTION

The present invention comprises the use of an elongated steel shaft or pin on which is attached at one end a collar having slanted edges and a protrusion thereon. A second collar having at least one slanted edge and possibly two is positioned on a concrete form and there is a latchpin hole in the collar which will match with a latch pin hole in the steel pin whereby a latch pin is inserted for removal. Prior to the pouring of concrete the steel pin or shaft is inserted through the second collar, the latch pin is positioned in place and the concrete is poured. After the concrete is cured the protrusion on the first collar is tapped and the edge of the first collar cams against the edge of the second collar and readily disengages the pin from the concrete.

An object of this invention is to provide a quick and easy method of making holes in concrete, particularly in conjunction with the construction of manholes and the use of steel forms.

Another object of this invention is to facilitate a rapid strip-out for removal of a concrete insert through just the simple tapping of a hammer to form a positive hold to receive an insert therein such as a prefabricated step.

Still another object of the present invention resides in the provision of the cam surface on a hole-forming insert member which matches with a stationary cam, such as on a concrete form, to facilitate ready removal through a cam action.

Other and further objects and advantages of this invention will become apparent upon reading the following specification taken in conjunction with the accompanying drawings.

DESCRIPTION OF A PREFERRED EMBODIMENT

Figure 1:
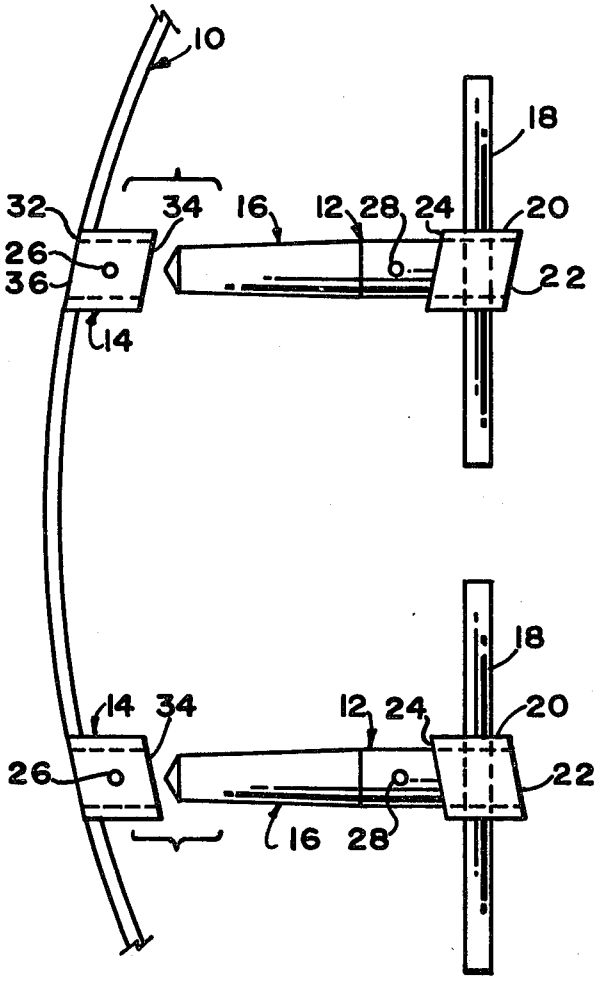
FIG. 1 is a top plan view of a pair of inserts of the present invention in place on a steel concrete form.

In FIG. 1 there is shown an assembly comprising a pair of the devices of the present invention to illustrate the use on a curved steel concrete form 10 which has been positioned in place through the usual practice of concrete manhole construction. Each assembly of the present device comprises a concrete insert member 12 and a collar 14. The concrete insert 12 comprises a steel, tapered shaft or pin member 16 having an elongated handle 18 inserted transversely therethrough and welded in place. Also welded or otherwise secured about the handle is a first collar 20 having opposed, parallel cams in the form of slanted cam edges or surfaces 22, 24 on opposite sides which in one embodiment are at an angle of approximately 12° with the transverse axis of the member 16. The angle can vary from about 8° to 18° depending upon manhole radius which can be anywhere from 18" to 36" (diameters 36"–72").

The second collar 14 is identical in construction with the first collar 20 except that it has a latchpin hole 26 therethrough for matching with a latchpin hole 28 in the member 16 to receive an elongated latchpin 30 therein. The second collar 14 is welded in place on the concrete form 10 in such a manner as to place the axis of the collar 14 to coincide with part of the radius of the circle which forms the form 10 and therefore one end 32 of second collar 14 is inserted through the form 10 and welded in place rather than welded to the outside or inside surface of form 10. Collar 14 has opposed, parallel cams in the form of cam edges or surfaces 34, 36.

The working length of the pin 16 is determined as to not only length but as to taper according to the final hole desired.

Figure 2:
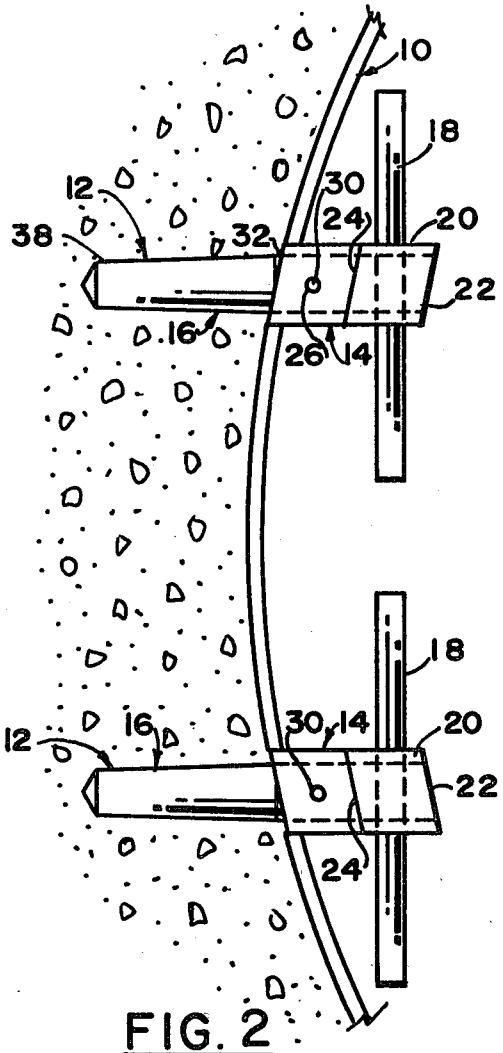
FIG. 2 is a top plan view similar to the view in FIG. 1 showing the positioning and removal of the steel pins.

The entire device 12 is inserted into the second collar 14 in the manner shown in FIG. 2 to bring the latch pinhole 26 of second collar 14 into alignment with the pinhole 28 in the steel member 16 to receive the latch pin 30 and to assemble the entire assembly in place on the concrete form 10 prior to the pouring of the concrete. After the pouring of the concrete in the form 10 as shown in FIG. 3 there is a quick removal and detachment of the pin 16 simply by tapping on the handle 18 after removal of the latchpin 30 and this will cause the cam edge 24 of first collar 20 to cam against the cam edge 34 of the second collar 14 creating a resolution of forces substantially along the longitudinal axis of pin 16 which readily detaches the pin 16 from the hole 38 in the concrete.

While I have shown and described a particular embodiment of this invention this is by way of illustration and does not constitute any limitation on the scope thereof because there are various alterations, changes, eliminations, deviations, omissions, and departures which may be made from the invention without avoiding the scope of the claims as defined only by a proper interpretation thereof.

What is claimed:

1. In a concrete insert to be positioned on and from one side of a concrete form prior to the pouring of concrete, such as forming step holes in a manhole, for removal to provide an opening in the concrete from one side thereof after the concrete has sufficiently cured:

a concrete insert assembly comprising an elongated, rigid concrete insert member for positioning through and from one side of the concrete form so as to be supported in place at the time the concrete is formed for subsequent removal therefrom to provide a hole in the concrete, an open insert retaining member attached to said concrete form on one side thereof to receive said insert member inserted therethrough for rotation therein so that said insert member projects through said form into the area in which concrete is poured for linear movement from said open retaining member and also projects in the other direction on the other side of the form, said retaining member having a cam edge on the external end providing a cam surface, a cam member on said insert member for cam engagement with the cam surface on said retaining member whereby said cam member is positioned against said cam surface in a selected position at the time the concrete is poured whereby rotation of said insert member, such as by manual movement from a tool, brings said cam member into engagement with said cam surface thereby causing linear displacement of said insert member to disengage and dislodge same from said concrete.

2. The device claimed in claim 1 wherein said insert member is an elongated tapered shaft and said retaining member is a circular collar and the cam surface is formed on the end of said collar.

3. The device claimed in claim 1 wherein there is a means for temporarily connecting said insert member to said retaining member to retain said insert member in position on said form prior to pouring the concrete.

4. The device claimed in claim 3 wherein said retaining member is a first collar and said first collar is cut at an angle on one end to provide the cam surface.

5. The device in claim 4 wherein said cam member is a second collar cut at an angle transversely thereof and being complementary to the cam member on the end of said retaining member whereby said retaining member and said cam member fit together in a complementary relationship to form a whole sleeve.

6. The device in claim 4, wherein: said angle of said cam member is approximately 12 degrees to the transverse axis of said insert member.

7. The device in claim 3, wherein: said means is a pin removably inserted in said insert member and said retaining member.

8. The device in claim 5 including a handle on said insert member extending transversely therefrom for rotating said insert member.

* * * * *